US012729533B2

(12) United States Patent
Hartwick

(10) Patent No.: US 12,729,533 B2
(45) Date of Patent: Sep. 8, 2026

(54) CORNER TRACKS FOR PANELIZED WALL SYSTEMS

(71) Applicant: Tremco CPG Inc., Beachwood, OH (US)

(72) Inventor: Randy Hartwick, Tempe, AZ (US)

(73) Assignee: Tremco CPG Inc., Beachwood, OH (US)

( * ) Notice: Subject to any disclaimer, the term of this patent is extended or adjusted under 35 U.S.C. 154(b) by 274 days.

(21) Appl. No.: 18/227,696

(22) Filed: Jul. 28, 2023

(65) Prior Publication Data

US 2025/0034860 A1 Jan. 30, 2025

(51) Int. Cl.
*E04B 1/38* (2006.01)
*E04B 1/12* (2006.01)

(52) U.S. Cl.
CPC ..... *E04B 1/388* (2023.08); *E04B 1/12* (2013.01)

(58) Field of Classification Search
CPC ..... E04B 1/388; E04B 1/12; E04B 2001/2463
USPC ..... 52/274, 272
See application file for complete search history.

(56) References Cited

U.S. PATENT DOCUMENTS 3,845,601 A * 11/1974 Kostecky ..... E04B 1/2403 52/656.1
6,256,960 B1 * 7/2001 Babcock ..... E04B 7/22 52/592.1
8,590,262 B1 * 11/2013 Fluga ..... E04B 1/26 52/741.1
8,938,927 B1 * 1/2015 Bragg ..... E04F 13/0878 52/715
9,745,711 B2 * 8/2017 Sluiter ..... E02D 27/32
10,151,106 B2 * 12/2018 Niemann ..... G06F 30/13
10,597,881 B1 * 3/2020 Huguet, Sr. ..... E04C 2/06
2003/0182886 A1 * 10/2003 Parrish ..... C04B 20/002 52/270
2005/0086894 A1 * 4/2005 Surowiecki ..... E04B 2/7457 52/633
2007/0199266 A1 * 8/2007 Geilen ..... E04C 2/205 52/426
2011/0225915 A1 * 9/2011 Swartz ..... E04B 2/7457 52/309.4
2012/0005971 A1 * 1/2012 Palmeri ..... E04B 7/04 52/220.1

(Continued)

OTHER PUBLICATIONS

Greg and Sue Burnet, Training the Trades, 2017, JLCOnline print-out pp. 11 and 12 (Year: 2017).*

*Primary Examiner* — Paola Agudelo
(74) *Attorney, Agent, or Firm* — Calfee, Halter & Griswold LLP

(57) ABSTRACT

A method includes measuring a first reference line inward from a first edge of a foundation slab. The method includes measuring a second reference line inward from a second edge of the foundation slab that is substantially perpendicular to the first edge and meets the first edge at a first corner of the foundation slab so that the first and second reference lines intersect at a first corner point on the foundation slab. A first corner track is placed in a first corner area so the first corner track is flush with the first and second reference lines. The method includes placing additional corner tracks in respective second corner areas so the corner tracks are flush with the respective reference lines. Edge tracks can be set on the foundation slab extending between the corner tracks, for receiving wall panels.

20 Claims, 7 Drawing Sheets

(56) References Cited

U.S. PATENT DOCUMENTS

2024/0401326 A1* 12/2024 Pospisil ..... E04B 1/388

* cited by examiner

CORNER TRACKS FOR PANELIZED WALL SYSTEMS

BACKGROUND

1. Field

The present disclosure relates to construction of buildings such as homes and light commercial buildings, and more particularly to systems and methods of constructing buildings using foam wall panels with fastening strips embedded in concrete studs and beams that are formed in situ within the wall panels, as described in U.S. Pat. No. 10,151,106 to Hercutech Inc, which is incorporated by reference herein in its entirety.

2. Description of Related Art

Single and multifamily residential and light commercial building construction, especially in North America, has been constructed predominately with wood frame or concrete block techniques. Both methods have provided safe, secure, economical and code compliant structures for most of the twentieth century. However, the growing populations, pressure on the world's wood and energy resources, and ever-increasing land resources utilized for landfill due to relatively short life cycles of conventional structures have caused society in general and the building construction industry to rethink new construction recyclability, and durability or a much extended life cycle all at a cost that is affordable on both a first cost and cost of occupancy basis. In addition, new construction technologies must be scalable. Many new methods have been developed to address one or more of these issues but few if any address all of them. Most come at a cost premium or are impractical for implementation in mass volumes.

An efficient building envelope has been proven to be the most cost effective method of maximizing the overall efficiency of a building structure and continues to keep energy costs low over the lifetime of the structure. The building envelope provides the barrier between the interior conditioned space and the outdoor environment. The energy efficiency of a building envelope is measured in two ways: the efficiency of the insulation and minimizing air infiltration and air leakage through the building envelope. The exterior walls of a structure are a key component and a significant contributor to the overall energy efficiency of the building envelope.

Concrete wall and floor construction has been a long time standard construction material in most of the world for all types of structures. Over the past 25 years, insulated concrete forms (ICF) systems have gained popularity and widespread acceptance and use, principally in North America. ICF systems provide a method of building pour-on-site concrete walls without the use of capital intensive and labor intensive permanent concrete forms, but generally ICF technology does not adequately address the issues of scalability and affordability. In particular, the current ICF systems require trained installers and large amounts of concrete to be poured.

The conventional techniques have been considered satisfactory for their intended purpose. However, there is an ever-present need for improved systems and methods for construction of buildings such as homes and light commercial buildings. This disclosure provides a solution for this need.

SUMMARY

A method includes measuring a first reference line inward from a first edge of a foundation slab. The method includes measuring a second reference line inward from a second edge of the foundation slab that is substantially perpendicular to the first edge and meets the first edge at a first corner of the foundation slab so that the first and second reference lines intersect at a first corner point on the foundation slab. A first corner track is placed in a first corner area so the first corner track is flush with the first and second reference lines. A third reference line is measured inward from a third edge of the foundation slab that is substantially perpendicular to the first edge and meets the first edge at a second corner of the foundation slab so that the first and third reference lines intersect at a second corner point of the foundation slab. The method includes placing a second corner track in a second corner area so the second corner track is flush with the first and third reference lines.

The method can include applying sealant to the foundation slab in the first corner area, wherein the first corner area is bounded by the first edge, the second edge, the first reference line, and the second reference line. The method can include applying sealant to the foundation slab in the second corner area, wherein the second corner area is bounded by the first edge, the third edge, the first reference line, and the third reference line.

The method can include applying sealant in a first edge area of the foundation slab between the first edge and the first reference line. A first edge track can be placed on the sealant in the first edge area with the first edge track extending from the first corner track to the second corner track.

The method can include determining a location for a third corner track for a third corner of the foundation slab by measuring across a first hypotenuse of the foundation slab from the first corner track to the third corner track and placing the third corner track according to the first hypotenuse even if it positions the third corner track off from the third reference line to ensure the first, second, and third corner tracks are positioned at right angles to one another to define a right angled rectangle on the foundation slab. Sealant can be applied to the foundation slab in a third corner area bounded by the third edge, a fourth edge of the foundation slab opposite the first edge, the third reference line, and a fourth reference line. The third corner track can be placed on the sealant in the second corner area so the second corner track is flush with the first and third reference lines.

The method can include applying sealant in a third edge area of the foundation slab between the third edge and the third reference line. A third edge track can be placed on the sealant in the third edge area with the third edge track extending from the second corner track to the third corner track.

The method can include determining a location for a fourth corner track for a fourth corner of the foundation slab by measuring across a second hypotenuse of the foundation slab from the second corner track to the fourth corner track and placing the fourth corner track according to the second hypotenuse even if it positions the fourth corner track off from the second reference line to ensure the first, third, and fourth corner tracks are positioned at right angles to one another to define a right angled rectangle on the foundation slab with the first, second, third, and fourth corner tracks. Sealant can be applied to the foundation slab in a fourth corner area bounded by the fourth edge, the second edge, the fourth reference line, and the second reference line. The fourth corner track can be placed on the sealant in the fourth corner area so the fourth corner track is flush with the second and fourth reference lines.

The method can include adjusting at least one of the third, fourth, and second reference lines based on locations determined for the third and fourth corner tracks to ensure the first, second, third, and fourth reference lines define a right-angled rectangle on the foundation slab. This can include changing amount of overhang of at least one of the third and fourth corner tracks to align edges of the at least one of the third and fourth corner tracks with the third, fourth, and second reference lines.

The method can include applying sealant in a fourth edge area of the foundation slab between the fourth edge and the fourth reference line. A fourth edge track can be placed on the sealant in the fourth edge area with the fourth edge track extending from the third corner track to the fourth corner track. The method can include applying sealant in a second edge area of the foundation slab between the second edge and the second reference line. A second edge track can be placed on the sealant in the second edge area with the second edge track extending from the fourth corner track to the first corner track.

The method can include installing a first corner panel into the first corner track; installing a first wall panel in the first edge track; installing a second corner panel into the second corner track; installing a third wall panel in the third edge track; installing a third corner panel into the third corner track; installing a fourth wall panel in the fourth edge track; installing a fourth corner panel into the fourth corner track; and installing a second wall panel in the second edge track. Concrete can be poured into voids defined in the first, second, third, and fourth wall panels and in the first, second, third, and fourth corner panels to form a reinforced concrete structure anchored to the foundation slab. A respective anchor bolt of the foundation slab can extend upward through a respective aperture in each of the first, second, third, and fourth corner track. Each respective anchor bolt can be encased in concrete in the reinforced concrete structure. A portion of each of the first, second, third, and fourth corner tracks overhang two of the first, second, third, and fourth edges of the foundation slab.

A corner track for constructing buildings includes a metallic main sheet with an aperture defined through the main sheet. A first vertical component extends perpendicularly from the main sheet along a first edge of the main sheet. A second vertical component extends perpendicularly from the main sheet along a second edge of the main sheet adjacent to the first edge, with the first and second vertical components meeting at a corner edge. A third edge of the main sheet is opposite the first edge, wherein the third edge is devoid of vertical components. A fourth edge of the main sheet is opposite the second edge, wherein the fourth edge is devoid of vertical components. The main sheet can define a square bounded by the first, second, third, and fourth edges.

A kit includes a plurality of corner tracks as described above. The kit includes a plurality of edge tracks. Each edge track includes a main sheet defining a plurality of apertures therethrough, a first vertical component extending perpendicularly from the main sheet of the edge track along a first edge of the main sheet of the edge track, and a second vertical component extending perpendicularly from the main sheet of the edge track along a second edge of the edge track opposite the first edge of the main sheet of the edge track. Opposed third and fourth edges of the main sheet of the edge track connecting across from the first and second edges of the main sheet of the edge track are devoid of vertical components.

A building includes a foundation slab and a kit as described above, wherein the corner tracks and edge tracks are installed on the foundation slab. The building includes a plurality of wall and corner panels assembled onto the corner tracks and the edge tracks with a reinforced concrete structure integrating the foundation slab, the corner tracks, the edge tracks, the wall panels, and the corner panels together.

These and other features of the systems and methods of the subject disclosure will become more readily apparent to those skilled in the art from the following detailed description of the preferred embodiments taken in conjunction with the drawings.

BRIEF DESCRIPTION OF THE DRAWINGS

So that those skilled in the art to which the subject disclosure appertains will readily understand how to make and use the devices and methods of the subject disclosure without undue experimentation, preferred embodiments thereof will be described in detail herein below with reference to certain figures, wherein.

DETAILED DESCRIPTION OF THE PREFERRED EMBODIMENTS

Figure 1:
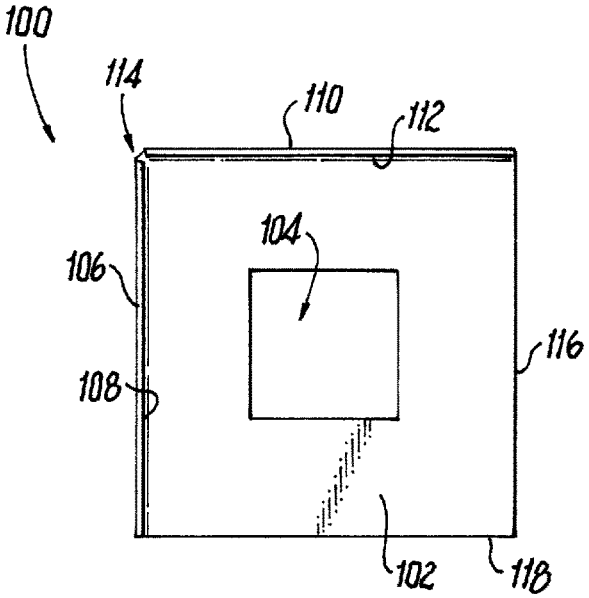
FIGS. 1-4 are schematic plan, first perspective, side elevation, and second perspective views, respectively, of an embodiment of a corner track constructed in accordance with the present disclosure, showing the vertical components and aperture.
Figure 2:
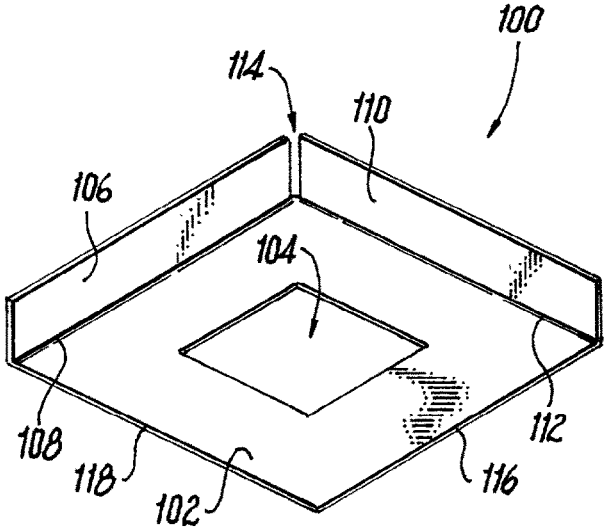

Reference will now be made to the drawings wherein like reference numerals identify similar structural features or aspects of the subject disclosure. For purposes of explanation and illustration, and not limitation, a partial view of an embodiment of a corner track in accordance with the disclosure is shown in FIG. 1 and is designated generally by reference character 100. Other embodiments of systems in accordance with the disclosure, or aspects thereof, are provided in FIGS. 2-13, as will be described. The systems and methods described herein can be used to provide tracks on a foundation slab for placing wall panels onto the foundation slab with the wall panels meeting at square corners even if the foundation slab is out of square at the corners. Those skilled in the art will readily appreciate that foundation slab as used herein need not necessarily apply only to foundation slabs that are on the ground, but could also apply to slabs on a second story or above. Those skilled in the art having had the benefit of this disclosure will also readily appreciate that while shown and described herein for a rectangular slab/floor plan, systems and methods as disclosed herein can readily be applied to other floor plans without departing from the scope of this disclosure.

Figure 3:
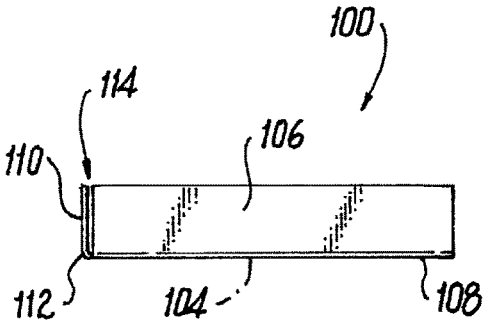
Figure 4:
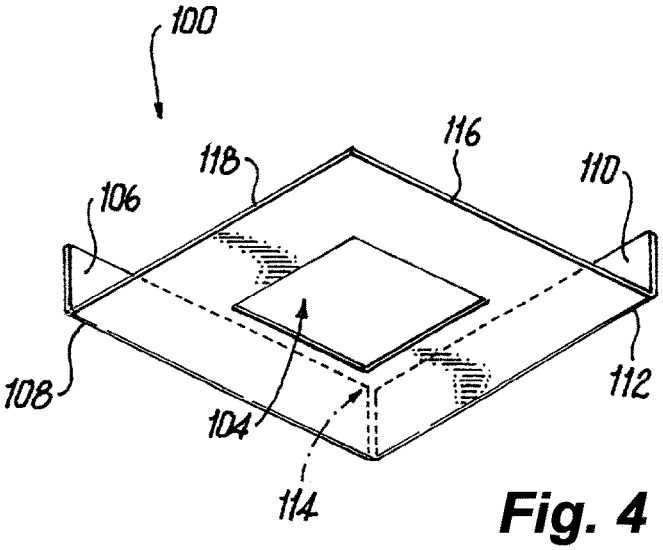
Figure 5:
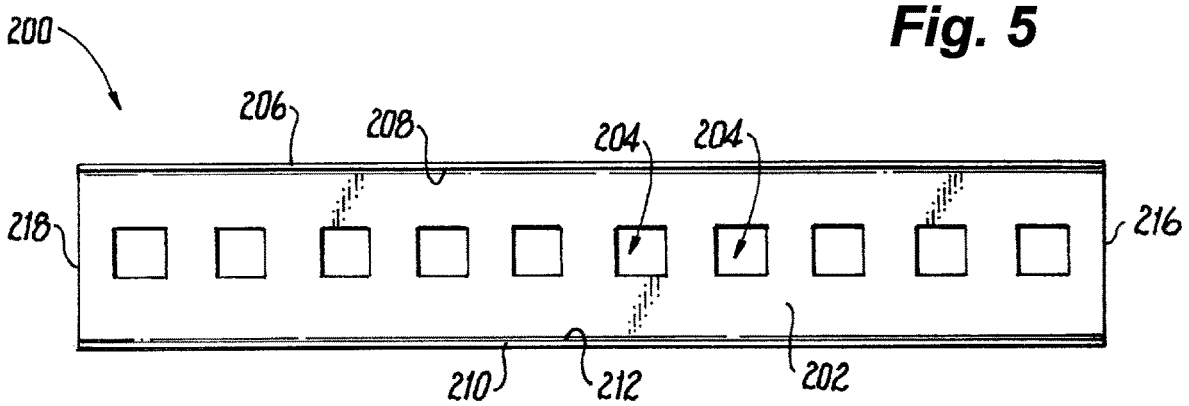
FIGS. 5-8 are schematic plan, end elevation, first perspective, and second perspective views, respectively, of an embodiment of an edge track constructed in accordance with the present disclosure, showing the vertical components and apertures.
Figure 6:
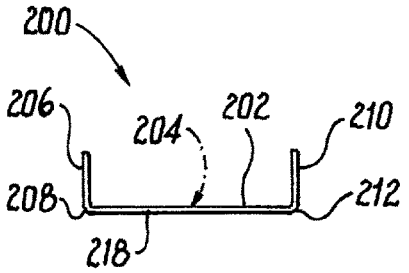
Figure 7:
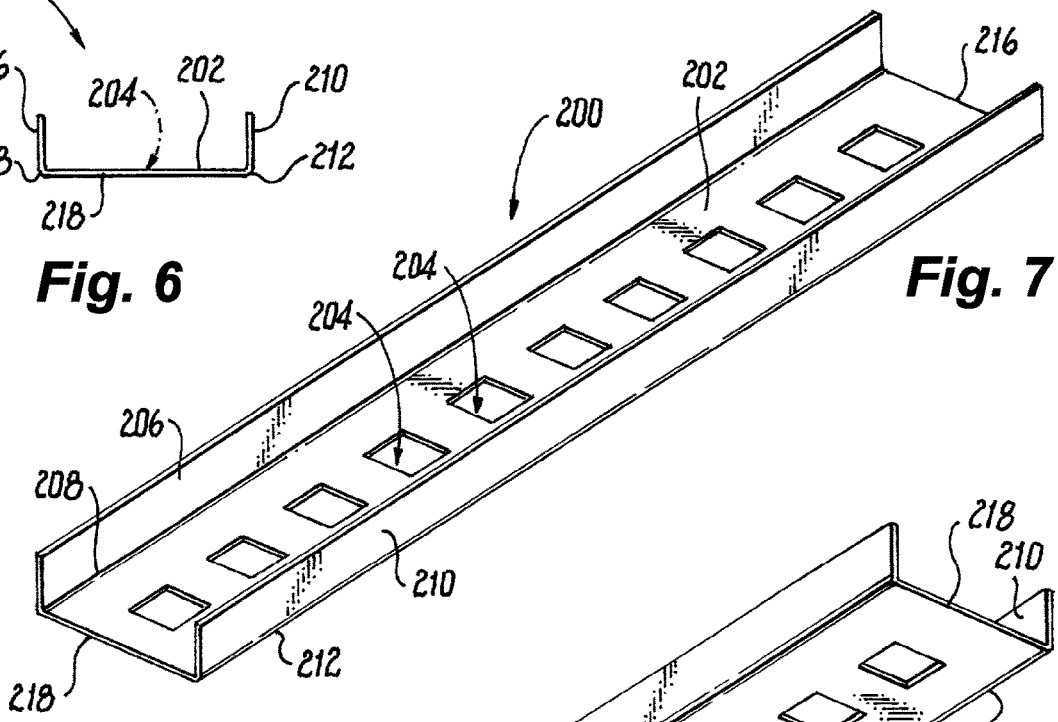
Figure 8:
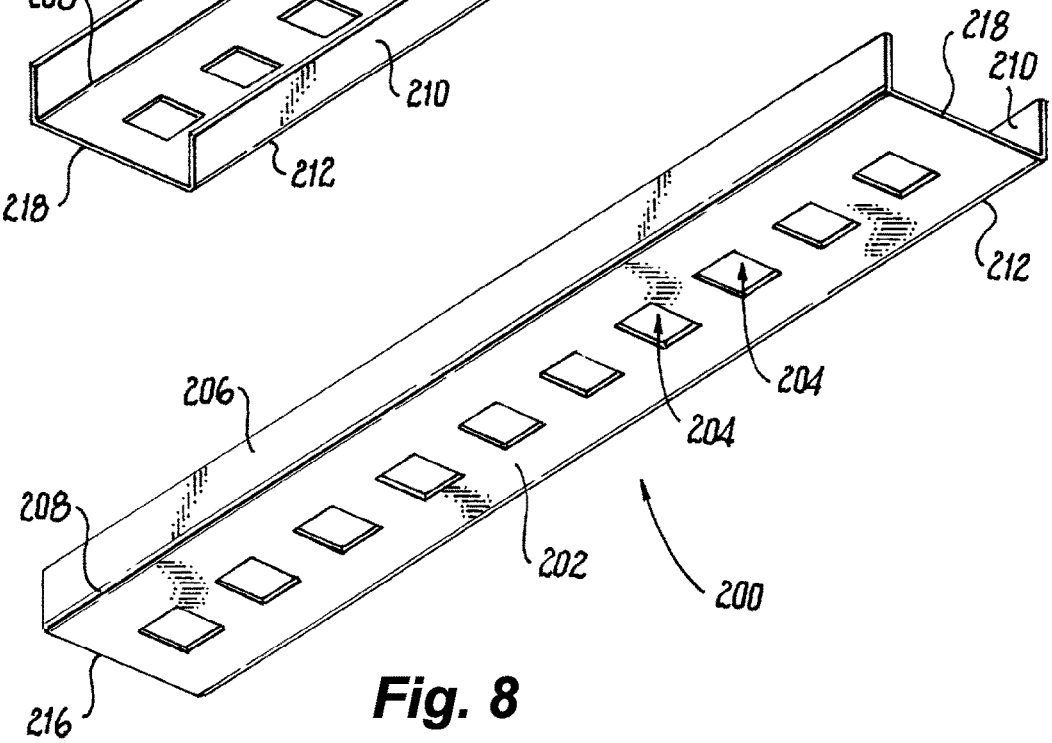

The corner track for constructing buildings includes a metallic main sheet 102 with an aperture 104 defined through the main sheet 102. A first vertical component 106 extends perpendicularly from the main sheet 102, e.g., upward as oriented in FIG. 2, along a first edge 108 of the main sheet 102. A second vertical component 110 extends perpendicularly from the main sheet 102, e.g. upward as oriented in FIG. 2, along a second edge 112 of the main sheet adjacent to the first edge 108. The first and second vertical components 106, 110 meet at a corner edge 114. A third edge 116 of the main sheet 102 is opposite the first edge 108, wherein the third edge 116 is devoid of vertical components. A fourth edge 118 of the main sheet 102 is opposite the second edge 112. The fourth edge 118 is also devoid of vertical components. The main sheet 102 defines a square bounded by the first, second, third, and fourth edges 108, 112, 116, 118, and the aperture 104 also defines a square that is centered in the main sheet 102 and aligned in parallel with the edges 108, 112, 116, 118. FIG. 3 shows the vertical components 106, 110 and main sheet 102 in elevation, and FIG. 4 shows the bottom surface of the main sheet 102 relative to the orientation in FIG. 2. The main sheet 102 and the vertical components 106, 110 can be made of steel.

With reference now to FIGS. 5-8, an edge track 200 includes a main sheet 202 defining a plurality of apertures 204 therethrough. A first vertical component 206 extends perpendicularly, e.g. upward as oriented in FIGS. 6-7, from the main sheet 202 along a first edge 208 of the main sheet 202. A second shear 210 strip extends perpendicularly, e.g. upward as oriented in FIGS. 6-7, from the main sheet 102 along a second edge 216 of the edge track 200 opposite the first edge 208 of the main sheet 202. Opposed third and fourth edges 216, 218 of the main sheet 202 that connect across from the first and third edges 208, 212 of the main sheet 202 of the edge track are devoid of vertical components. A plurality of the corner tracks 100 of FIGS. 1-4 and edge tracks 200 of FIGS. 5-8 can be provided to builders as a kit, together with a plurality of wall and corner panels as described below.

Figure 9:
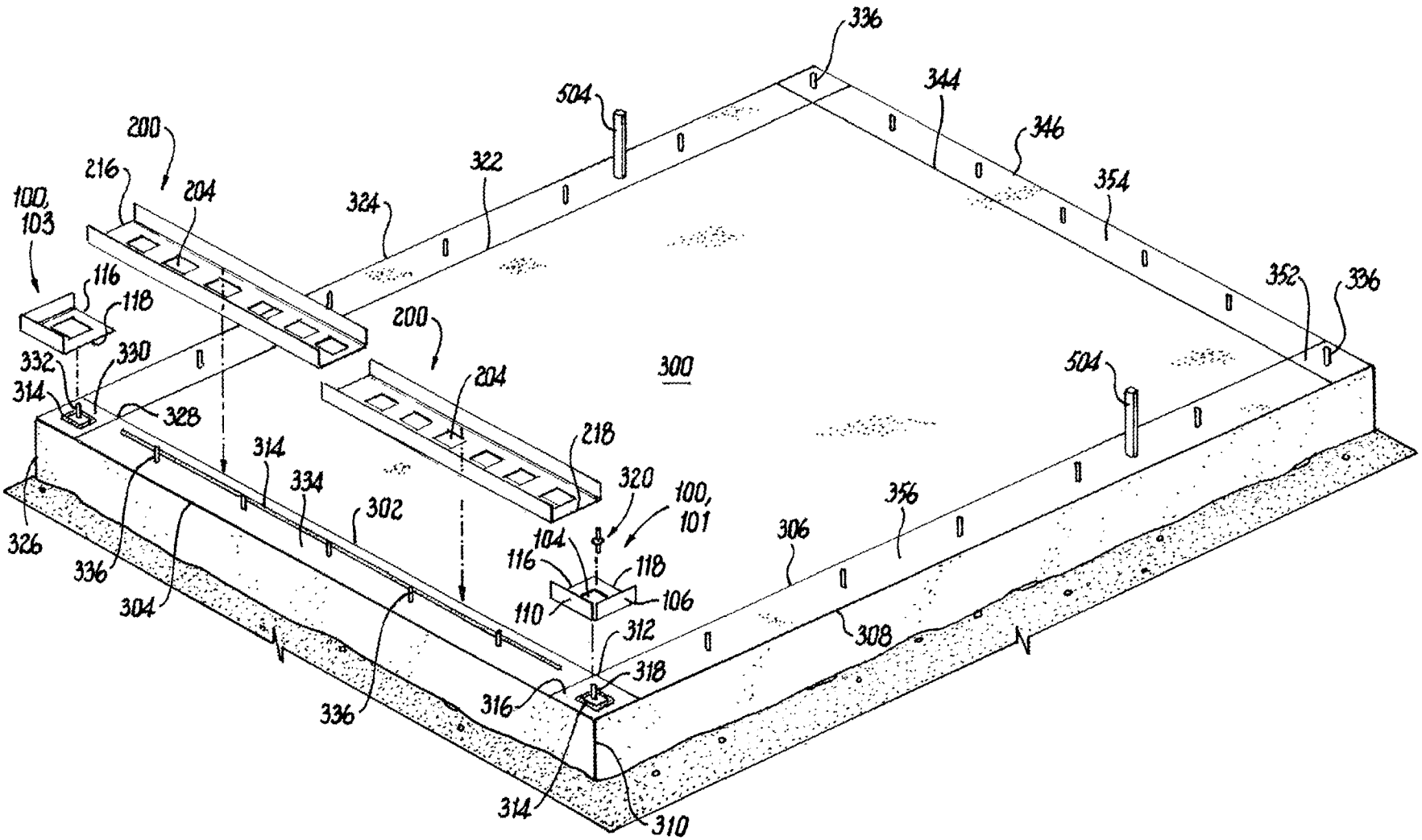
FIGS. 9-13 are schematic perspective views showing respective stages in a process for forming a reinforced concrete structure using corner and edge tracks as in FIGS. 1-8.

With reference now to FIG. 9, a method of placing tracks for constructing a building is described with reference to a foundation slab 300 for the building. As indicated above, although the slab 300 is depicted in FIG. 9 as being on the ground, those skilled in the art will readily appreciate that the system and methods disclosed herein can be applied to a slab on a second story of a building or above the second story without departing from the scope of this disclosure. The method includes measuring a first reference line 302 inward from a first edge 304 of the foundation slab 300. The first referend line can be marked on the top surface of the slab 300, e.g. the reference lines referred to herein can be marked by using a chalk snap line. The method includes measuring a second reference line 306 inward from a second edge 308 of the foundation slab 300 that is substantially perpendicular to the first edge 304 and meets the first edge 304 at a first corner 310 of the foundation slab 300 so that the first and second reference lines 302, 306 intersect at a first corner point 312 on the foundation slab 300.

With continued reference to FIG. 9, the method includes applying sealant 314 to the foundation slab in a first corner area 316, wherein the first corner area 316 is bounded by the first edge 304, the second edge 308, the first reference line 302, and the second reference line 306. The sealant 314 is applied in a complete ring around anchor bolt 318 extending upward out of the foundation slab 300 in the first corner area 316. A first corner track 100, as described above with reference to corner track 100 in FIGS. 1-4 and designated in FIG. 9 as 101, is placed on the sealant 314 in the first corner area 316 so the respective edges 116 and 118 of the first corner track 101 are flush with the first and second reference lines 306, 302. The corner track 101 can be secured to the slab 300 using power actuated fasteners 320 or the like. The anchor bolt 318 extends through the aperture 104 of the first corner track 101 with the first corner track 101 secured to the slab 300.

A third reference line 322 is measured and can be marked as described above, inward from a third edge 324 of the foundation slab 300 that is substantially perpendicular to the first edge 304. The third reference line 322 is opposite across the foundation slab 300 from the second edge 308 and meets the first edge 304 at a second corner 326 of the foundation slab 300 so that the first and third reference lines 302, 322 intersect at a second corner point 328 of the foundation slab 300. The method includes applying sealant 314, in a complete ring around the anchor bolt 332 as described above, to the foundation slab 300 in the second corner area 330. The second corner area 330 is bounded by the first edge 304, the third edge 324, the first reference line 302, and the third reference line 322. The method includes placing a second corner track 103, as described above with reference to corner track 100 and designated in FIG. 9 as corner track 103, on the sealant 314 in the second corner area 330 so edges 116, 118 of the second corner track 103 are flush with the first and third reference lines 302, 322 as described above for the first corner track 101.

With continued reference to FIG. 9, the method includes applying sealant 314 in a first edge area 334 of the foundation slab 300 between the first edge 304 and the first reference line 302, where the sealant 314 is applied to be inward from the anchor bolts 336 of the first edge area 334, so as to ultimately be inward on the slab 300 from the apertures 204 through the edge tracks 200. A first edge track 200, or multiple edge tracks 200 end to end, is placed on the sealant 314 in the first edge area 334 with the first edge track or tracks 200 extending from the first corner track 101 to the second corner track 103, i.e. to have an edge 218 flush with an edge 116 of the first corner track, and an edge 216 flush with the edge 118 of the second corner track 103 as shown in FIG. 10.

Figure 10:
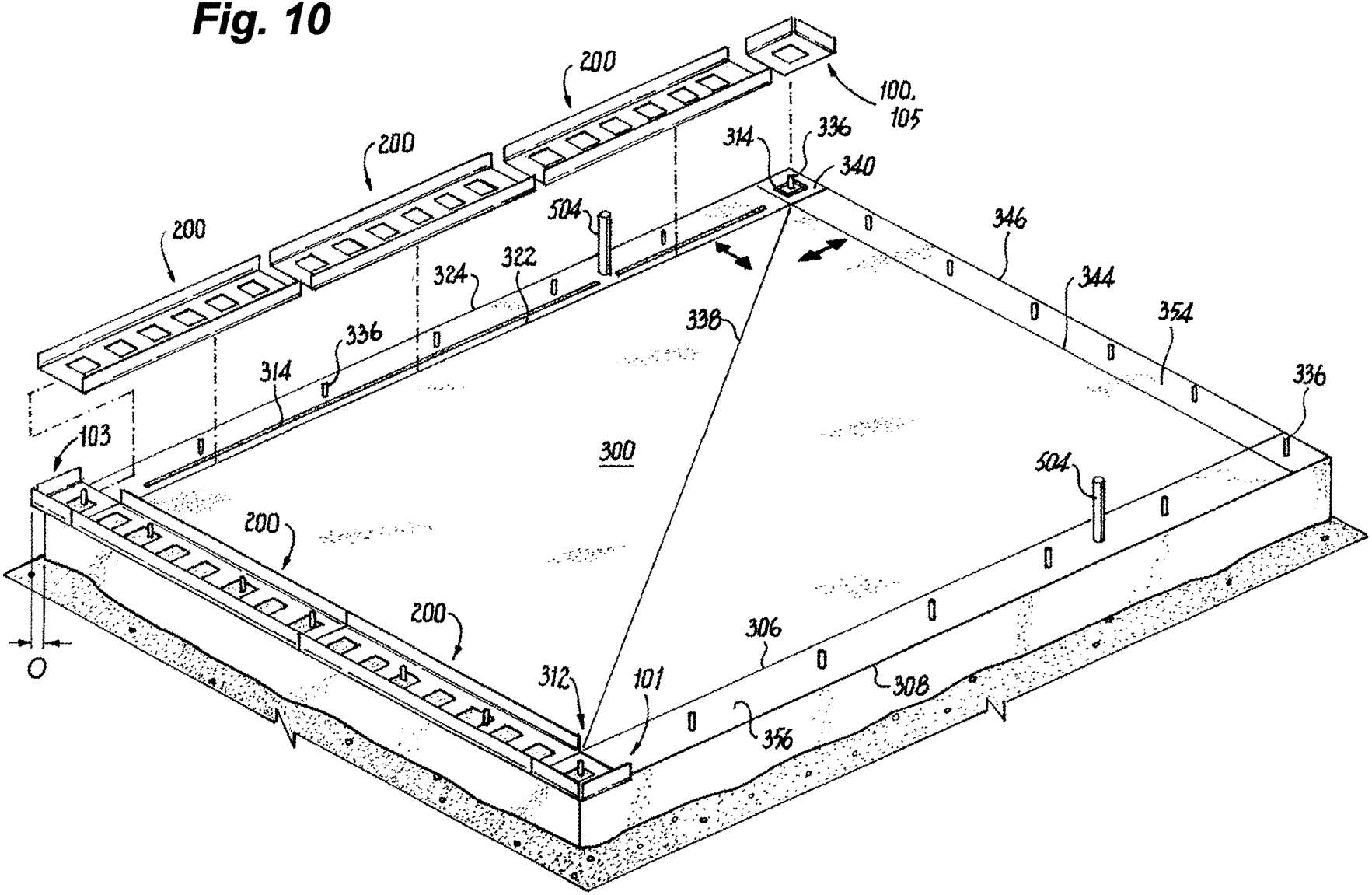

With reference to FIG. 10, the method includes determining a location of a third corner area 340 of the foundation slab 300 for a third corner track, which is as described above with reference to corner track 100 in FIGS. 1-4 and designated in FIG. 10 as 105. A fourth reference line 344 can be initially estimated by measuring inward from the fourth edge 346 of the slab 300 so the fourth reference line 344 is initially parallel to the fourth edge 346 as done for the other reference lines 302, 306, 322. A third corner point 348 is defined at the intersection of the third and fourth reference lines 322, 344. Since the slab 300 may not be square at each of its corners, the location for the third corner area 340 can be refined by measuring across a first hypotenuse 338 of the foundation slab 300 from the first corner track 101 to the location for the third corner track 105, wherein the first hypotenuse 338 passes through the first and third corner points 312, 348. Based on the geometric assumption that the tracks 100, 200 should be laid down on square corners, i.e. right angles, the first hypotenuse should be part of a right triangle with two baselines that meet each other at a right angle. The length of the first reference line 302 (labeled in FIG. 9) can be used as the first baseline length of the right triangle and the length of the third reference line 322 or second reference line can be used as the length of the second baseline of the right triangle. The proper length of the first hypotenuse 338 is therefore the square root of the sum of the squares of the first and second baseline lengths. Measuring out the proper length along the first hypotenuse 338 from the first corner track 101 to the location for the third corner track 105, e.g. starting at the first corner point 312 can result in the need to deviate from the third and/or fourth reference lines 322, 344 in placing the third corner track 105. For example, the fourth corner point 348 may need to be moved toward or away from the first corner point 312 along the first hypotenuse 338 to provide the proper position for placing the third corner track 105. After determining the location for the fourth corner point 348, the third and/or fourth reference lines 322, 344 can be re-marked on the slab 300, as indicated in FIG. 10 by the double arrows. The first hypotenuse 338 can be measured form any suitable point, e.g., from corner point 312 to corner point 348, or from other points inside the corner areas 316, 340 as long as they are consistent.

With continued reference to FIG. 10, the third corner track 105 can be placed according to location determined from the first hypotenuse 348 even if it positions the third corner track 105 off from the third reference line or fourth reference lines 322, 344 to ensure the first, second, and third corner tracks 101, 103, 105 are positioned at right angles to one another to define a right-angled rectangle on the foundation slab 300. As described above with reference to FIG. 9 for corner tracks 101, 103, sealant 314 is applied to the foundation slab 300 in the third corner area 340 bounded by the third edge 324, the fourth edge 346, the third reference line 322, and the fourth reference line 344, e.g., as determined based on the location for the third corner track 105 and a location for the fourth corner track 107 as will be described below. The third corner track 105 is placed on the sealant 314 in the second corner area so the third corner track is flush, i.e. its edges 116, 118 are flush, with the first and third reference lines 322, 344, e.g. using fasteners as described above. The method includes applying sealant 314 in a third edge area of the foundation slab between the third edge 324 and the third reference line 322. A third edge track 200, or a plurality of edge tracks as needed, is placed on the sealant 314 in the third edge area with the third edge track or tracks 200 extending from the second corner track 103 to the third corner track 105 so that edges 216, 218 are flush with an edge 116 of the second corner track 105 and with an edge 118 of the third corner track 107, as the edges 116, 118 are labeled in FIGS. 1-4.

The method includes determining a location for a fourth corner track, as describe above with reference to corner track 100 in FIGS. 1-4 and designated as 107, for a fourth corner of the foundation slab 300 by measuring across a second hypotenuse 350 of the foundation slab 300 from the second corner track 103 to the fourth corner track 107 and placing the fourth corner track 107 according to the second hypotenuse 350 even if it positions the fourth corner track 107 off from the initial second reference line 306 and/or from the initial fourth reference line 344 to ensure the corner tracks 101, 103, 105, 107 are positioned at right angles to one another to define a right angled rectangle on the foundation slab 300 with the first, second, third, and fourth corner tracks 200. The second hypotenuse 350 can be determined and used in the same manner as described above for the first hypotenuse 338 in FIG. 10, but for the corners of the slab 300 corresponding to the second and third corner tracks 103, 107, wherein the second and fourth reference lines 306, 344 can be repositioned as needed based on the determination from the second hypotenuse, as indicated in FIG. 11 by the double arrows.

Sealant 314 is applied to the foundation slab in a fourth corner area 352 bounded by the fourth edge 346, the second edge 308, the fourth reference line 344, and the second reference line 306, which are determined based on the location for the fourth corner track 107 as described above. The fourth corner track 107 is placed on the sealant 314 in the fourth corner area 352 and secured to the slab 300, e.g., using fasteners as described above, so the edges 116, 118 (labeled in FIGS. 1-4) of the fourth corner track 107 are flush with the second and fourth reference lines 306, 344.

The method includes adjusting at least one of the third, fourth, and second reference lines 322, 344, 306 based on locations determined for the third and fourth corner tracks 105, 107 to ensure the first, second, third, and fourth reference lines 302, 306, 322, 344 define a right-angled rectangle on the foundation slab 300 even if the foundation slab 300 itself is out of square, i.e. does not conform to a right-angled rectangle. This can include changing amount of overhang O, labeled in FIG. 10 of at least one of the third and fourth corner tracks 105, 107, e.g. slightly to ensure wall panels discussed below go in square at the corners, to align edges 116, 118 of the at least one of the third and fourth corner tracks 105, 107 with the third, fourth, and second reference lines 322, 344, 306, and ultimately with the mating edges 216, 218 of the edge tracks 200. The locations for the third and fourth corner tracks 105, 107 can optionally be determined using the methods above before securing either of the corner tracks 105, 107 or any of the edge tracks 200 to the slab 300.

Figure 11:
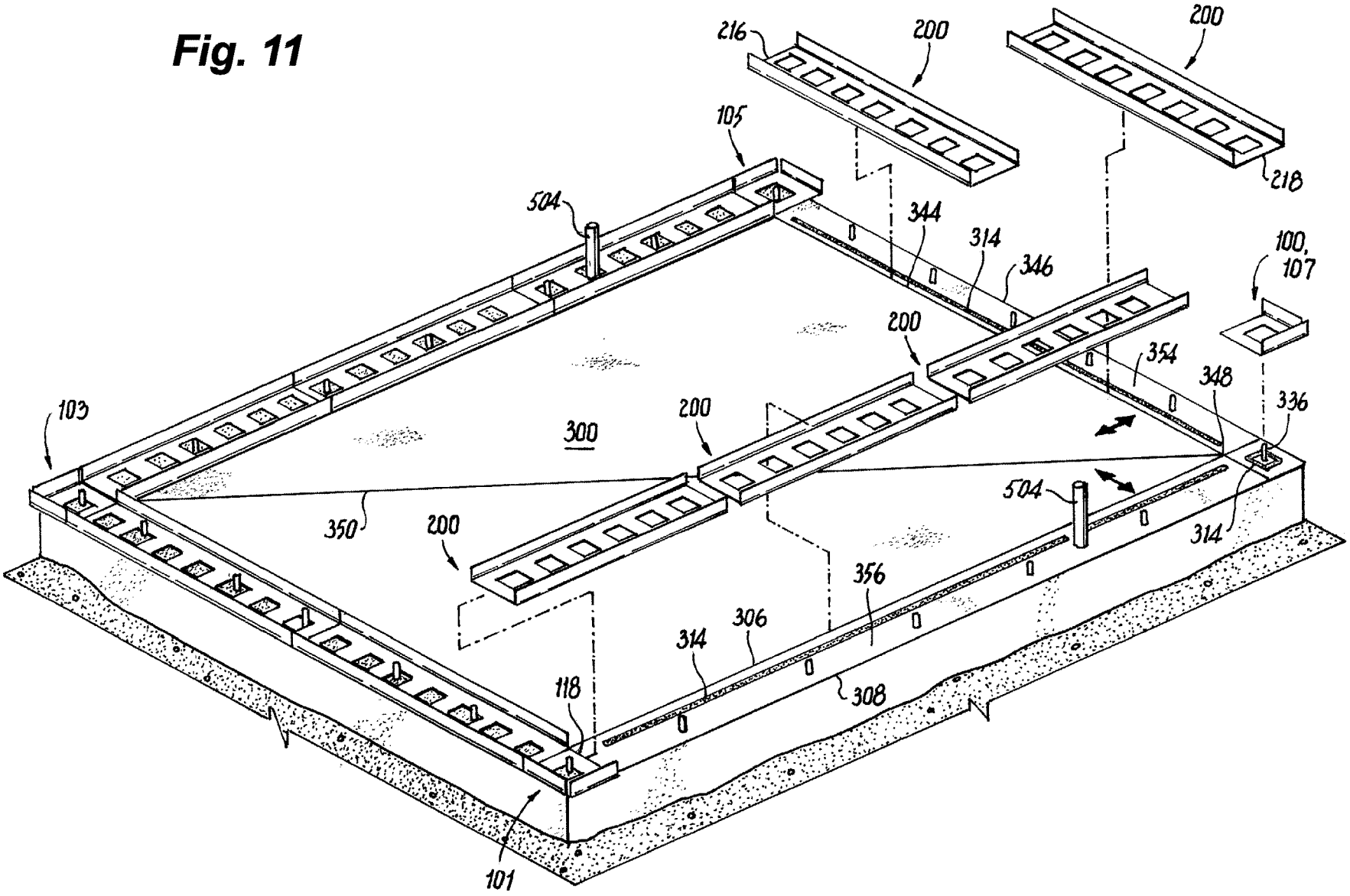

With continued reference to FIGS. 11, the method includes applying sealant 314 in a fourth edge area 354 of the foundation slab 300 between the fourth edge 346 and the fourth reference line 344. A fourth edge track or tracks 200 is/are placed on the sealant 314 in the fourth edge area 354 with the fourth edge track or tracks 200 extending from the third corner track 105 to the fourth corner track 107 so edges 216, 218 of the edge track or tracks 200 end up flush with an edge 116 (labeled in FIGS. 1-4) of the third corner track 105 and with an edge 118 (labeled in FIGS. 1-4) of the fourth corner track 107. The method includes applying sealant 314 in a second edge area 356 of the foundation slab 300 between the second edge 308 and the second reference line 306. A second edge track or tracks 200 is/are placed on the sealant 314 in the second edge area 356 with the second edge track or tracks 200 extending from the fourth corner track 107 to the first corner track 101, so edges 216, 218 of the edge track or tracks 200 end up flush with an edge 116 (labeled in FIGS. 1-4) of the fourth corner track 107 and with an edge 118 (labeled in FIGS. 1-4) of the first corner track 101. When setting down edge tracks 200 the edge tracks 200 should be set down to align with the respective corner tracks 100 as opposed to strictly following the reference lines 302, 306, 322, 344. Each of the edge tracks 200 and corner tracks 101, 103, 105, 107 can be secured to the foundation slab 200, e.g., using power actuated fasters 320 (labeled in FIG. 9).

Figure 12:
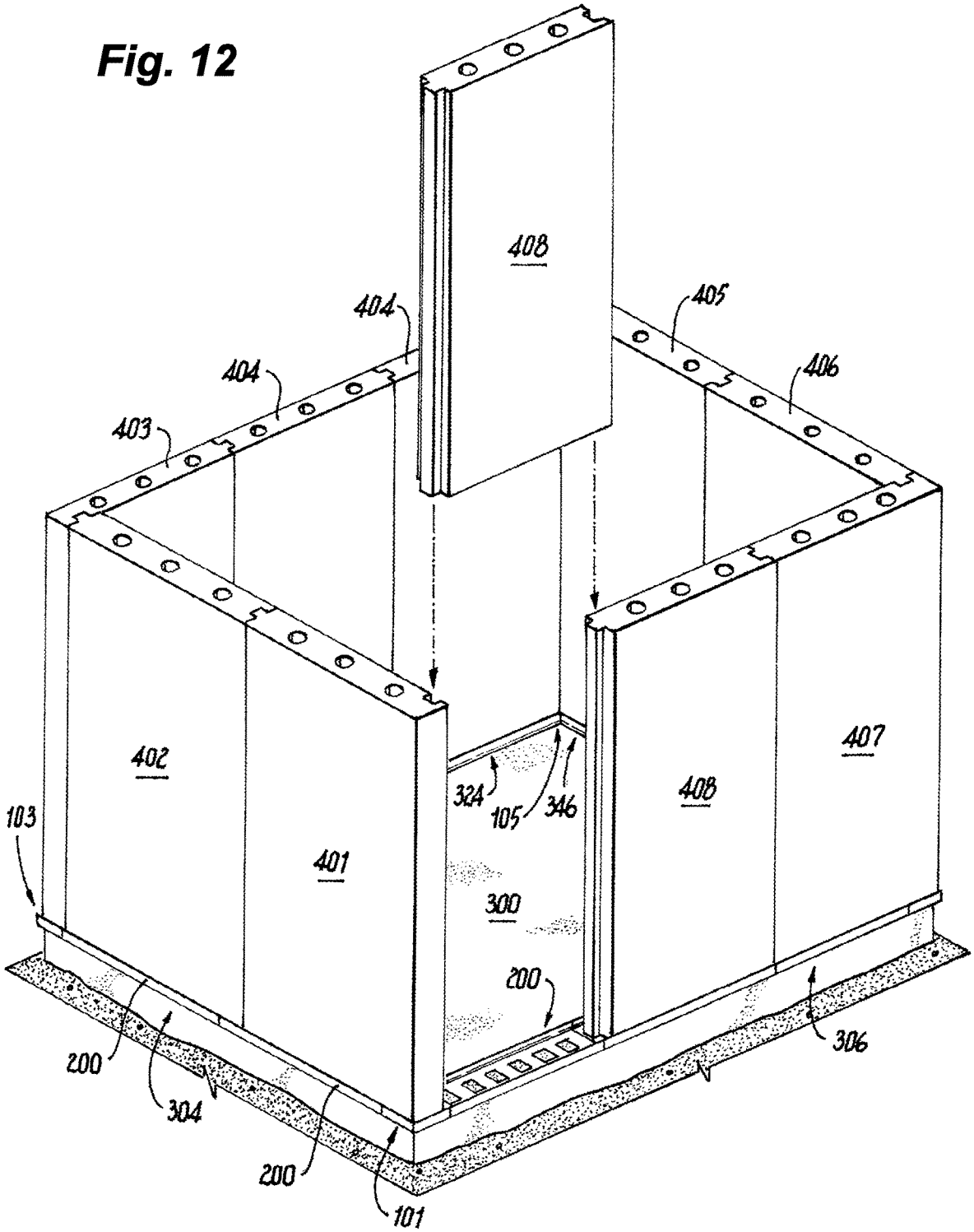
Figure 13:
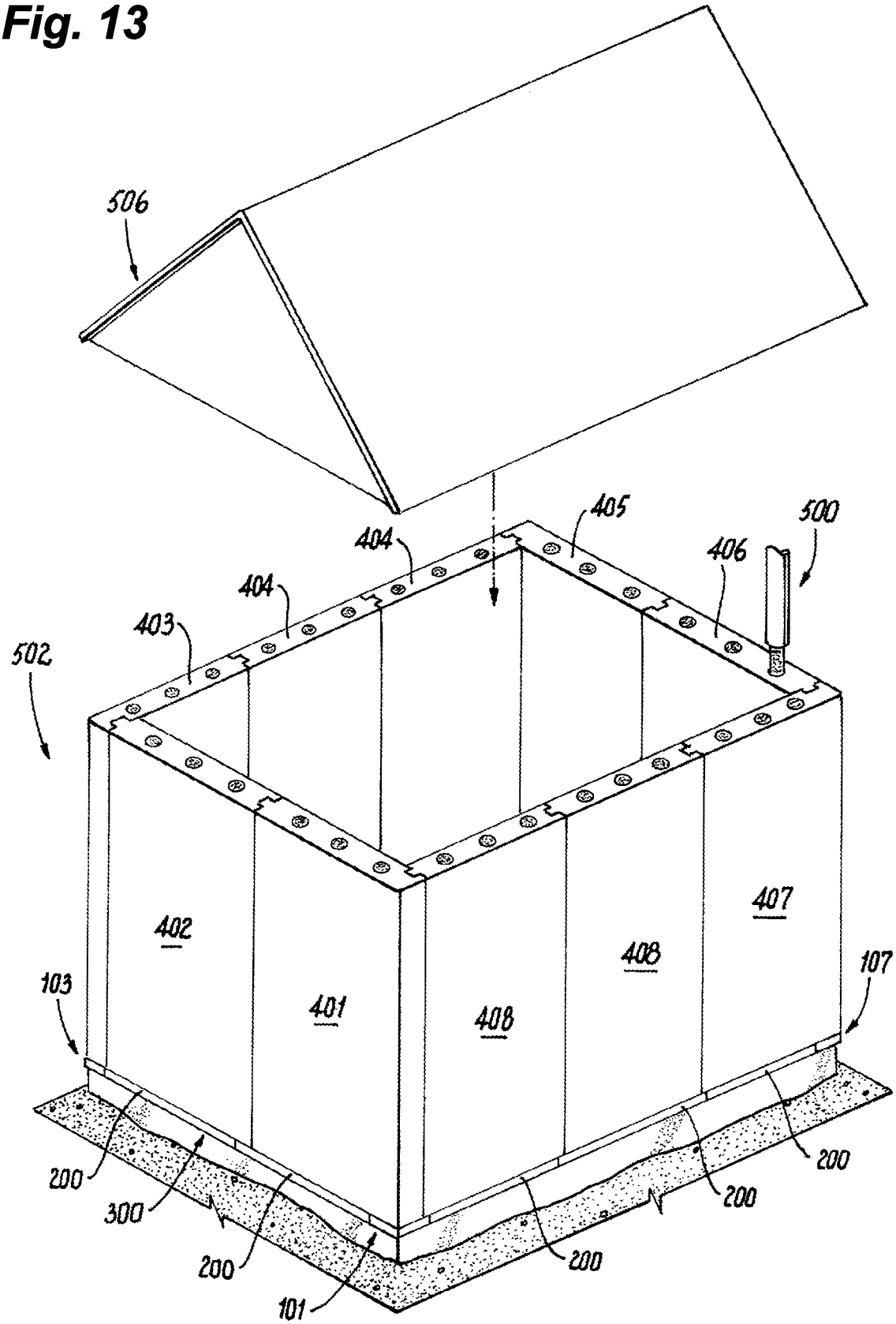

Once the corner and edge tracks 100, 200 are all secured to the foundation slab 300 forming a circuitous track, the prefabricated wall panels can be installed into the circuitous track formed by the edge and corner tracks 100, 200 as described below with reference to FIG. 12. Prefabricated wall panels are described in greater detail in U.S. Pat. No. 10,151,106 which is incorporated by reference herein in its entirety. The method includes installing a first corner panel 401 into the first corner track 101 and installing a first wall panel or plurality of panels 402 in the edge track or tracks 200 of the first edge 304 of the slab 300 with the panel or panels 302 also engaged with the first corner panel 401. A second corner panel 403 can then be installed into the second corner track 103 engaged with the wall panel or panels 402 of the edge 304 of the slab 300. A third wall panel or plurality of panels 404 can then be installed in the edge tracks 200 of the edge 324 of the slab 300, and engaged with the second corner panel or panels 403. A third corner panel 405 is installed into the third corner track 105 and engaged with the third wall panel or panels 404. A fourth wall panel or plurality of panels 406 is installed into in the edge track or tracks 200 of the fourth edge 346 of the slab 300 and engaged with the third corner panel 405. A fourth corner panel 407 is installed into the fourth corner track 107 and engaged with the wall panel or panels 406 of the fourth edge 346. A second wall panel or plurality of panels 408 can be installed in the edge track or tracks 200 of the second edge 308 and engaged with the first and fourth corner panels 401, 407. The corner panels 401, 403, 405, 407 can extend beyond their respective corner tracks 101, 103, 105, 107 and into the adjacent edge track or tracks 200. The wall and corner panels described above can be installed in any suitable order without departing from the scope of this disclosure, however those skilled in the art will readily appreciate advantages of beginning with one corner panel, and installing following panels around the perimeter until the last wall panel engages with the first corner panel. The resulting building structure is shown in FIG. 13. Although the corner panels 401, 403, 407, 405 are shown as being about the same size as the wall panels 402, 404, 406, 408, those skilled in the art will readily appreciation that the corner panels 401, 403, 407, 405 can be of a different size. For example, the corner panels can have a square footprint corresponding to the size of the corner tracks 100, or can be of any other suitable size.

With reference now to FIG. 13, concrete 500 can be poured into voids defined in the prefabricated panels 401-408 to form a reinforced concrete structure 502 anchored to the foundation slab 300 and integrated with the panels 401-408 and integrated with the corner tracks 101, 103, 105, 107, 200. A respective anchor bolt 318, 332, 336 (labeled in FIG. 9) of the foundation slab 300 extends upward through a respective aperture 104, 204 in each of the corner and edge tracks 101, 103, 105, 107, 200, and into the concrete 500 forming the reinforced concrete studs within the wall and corner panels 401-408. Additional structures 504 such as electrical conduits, fluid pipes, or other electrical or mechanical structures, can also extend upward through respective apertures 104, 204 as needed, and can be encased in concrete 500 in the concrete studs of the prefabricated panels 401-408. A portion of each of the first, second, third, and fourth corner tracks 101, 103, 105, 107 and edge tracks 200 overhang two of the respective edges 304, 306, 324, 346 of the foundation slab 300, so the prefabricated panels can fill the tracks 101, 103, 105, 107, 200 also overhang to describe an outer perimeter slightly larger than the outer perimeter of the foundation slab 300. The vertical components 106, 110, 206, 210 of the tracks 101, 103, 105, 107, 200 keep the panels 401-408 from lifting out of the circuitous track when pouring the concrete 500. Finishing structures such as roofing 506 can be added to the structure 502.

The methods and systems of the present disclosure, as described above and shown in the drawings, provide for placing tracks on a foundation slab for placing wall panels onto the foundation slab with the wall panels meeting at square corners even if the foundation slab is out of square at the corners. While the apparatus and methods of the subject disclosure have been shown and described with reference to preferred embodiments, those skilled in the art will readily appreciate that changes and/or modifications may be made thereto without departing from the scope of the subject disclosure.

What is claimed is:

1. A method comprising:

measuring a first reference line inward from a first edge of a foundation slab;

measuring a second reference line inward from a second edge of the foundation slab that is substantially perpendicular to the first edge and meets the first edge at a first corner of the foundation slab so that the first and second reference lines intersect at a first corner point on the foundation slab;

placing a first corner track in a first corner area so the first corner track is flush with the first and second reference lines;

measuring a third reference line inward from a third edge of the foundation slab that is substantially perpendicular to the first edge and meets the first edge at a second corner of the foundation slab so that the first and third reference lines intersect at a second corner point of the foundation slab;

placing a second corner track in a second corner area so the second corner track is flush with the first and third reference lines;

placing a first edge track along the first edge of the foundation slab, to extend between the first and second corner tracks; and installing a wall panel into the first edge track and at least one of the first and second corner tracks, with the wall panel being received between vertical components of the first edge track and the at least one of the first and second corner tracks.

2. The method as recited in claim 1, further comprising:

applying sealant to the foundation slab in a first corner area, wherein the first corner area is bounded by the first edge, the second edge, the first reference line, and the second reference line.

3. The method as recited in claim 1, further comprising:

applying sealant to the foundation slab in a second corner area, wherein the second corner area is bounded by the first edge, the third edge, the first reference line, and the third reference line.

4. The method as recited in claim 1, further comprising:

applying sealant in a first edge area of the foundation slab between the first edge and the first reference line;

placing the first edge track on the sealant in the first edge area.

5. The method as recited in claim 1, further comprising:

determining a location for a third corner track for a third corner of the foundation slab by measuring across a first hypotenuse of the foundation slab from the first corner to the third corner and placing the third corner track according to the first hypotenuse to ensure the first, second, and third corner tracks are positioned at right angles to one another to define a right angled rectangle on the foundation slab.

6. The method as recited in claim 5, further comprising:

applying sealant in a third edge area of the foundation slab between the third edge and the third reference line; and placing a third edge track on the sealant in the third edge area with the third edge track extending from the second corner track to the third corner track.

7. The method as recited in claim 6, further comprising:

determining a location for a fourth corner track for a fourth corner of the foundation slab by measuring across a second hypotenuse of the foundation slab from the second corner track to the fourth corner track and placing the fourth corner track according to the second hypotenuse even if it positions the fourth corner track off from the second reference line to ensure the first, third, and fourth corner tracks are positioned at right angles to one another to define a right angled rectangle on the foundation slab with the first, second, third, and fourth corner tracks;

applying sealant to the foundation slab in a fourth corner area bounded by the fourth edge, the second edge, the fourth reference line, and the second reference line;

placing the fourth corner track on the sealant in the fourth corner area so the fourth corner track is flush with the second and fourth reference lines.

8. The method as recited in claim 7, further comprising:

adjusting at least one of the third, fourth, and second reference lines based on locations determined for the third and fourth corner tracks to ensure the first, second, third, and fourth reference lines define a right-angled rectangle on the foundation slab.

9. The method as recited in claim 8, further comprising changing amount of overhang of at least one of the third and fourth corner tracks to align edges of the at least one of the third and fourth corner tracks with the third, fourth, and second reference lines.

10. The method as recited in claim 7, further comprising:

applying sealant in a fourth edge area of the foundation slab between the fourth edge and the fourth reference line; and placing a fourth edge track on the sealant in the fourth edge area with the fourth edge track extending from the third corner track to the fourth corner track.

11. The method as recited in claim 10, further comprising:

applying sealant in a second edge area of the foundation slab between the second edge and the second reference line; and placing a second edge track on the sealant in the second edge area with the second edge track extending from the fourth corner track to the first corner track.

12. The method as recited in claim 1, further comprising:

pouring concrete into voids defined in the first wall panel to form a reinforced concrete structure anchored to the foundation slab.

13. The method as recited in claim 12, wherein an anchor bolt of the foundation slab extends upward through an aperture in the first corner track.

14. The method as recited in claim 12, wherein the anchor bolt is encased in concrete in the reinforced concrete structure.

15. The method as recited in claim 12, wherein a portion of each of the first and second corner tracks overhang two of the first, second, and third edges of the foundation slab.

16. A method comprising:

placing a corner track in a corner area of a foundation slab;

placing an edge track along an edge of the foundation slab extending to the corner area, to extend from the corner track;

installing a wall panel into the edge track and the corner track, with the wall panel being received between vertical components of the edge track and the corner track; and pouring concrete into voids defined in the wall panel to form a reinforced concrete structure anchored to the foundation slab, with the vertical components retaining the wall panel against lifting out of the corner track and the edge track.

17. The method as recited in claim 16, wherein an anchor bolt of the foundation slab extends upward through an aperture in the corner track.

18. The method as recited in claim 17, wherein the anchor bolt is encased in concrete in the reinforced concrete structure.

19. The method as recited in claim 16, wherein a portion of the corner track overhangs the edge of the foundation slab.

20. The method as recited in claim 16, further comprising securing the corner track an the edge track to the foundation slab using an adhesive.

* * * * *